US010524543B2

(12) United States Patent
Baudouin et al.

(10) Patent No.: US 10,524,543 B2
(45) Date of Patent: Jan. 7, 2020

(54) ARTICLE OF FOOTWEAR WITH SELF-CLEANING CLEATS

(71) Applicants: Alexandre Baudouin, Portland, OR (US); Thomas J. Rushbrook, Portland, OR (US); Denis Schiller, Vancouver, WA (US)

(72) Inventors: Alexandre Baudouin, Portland, OR (US); Thomas J. Rushbrook, Portland, OR (US); Denis Schiller, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 238 days.

(21) Appl. No.: 15/036,511

(22) PCT Filed: Nov. 13, 2014

(86) PCT No.: PCT/US2014/065377

§ 371 (c)(1),
(2) Date: May 13, 2016

(87) PCT Pub. No.: WO2015/073629

PCT Pub. Date: May 21, 2015

(65) Prior Publication Data

US 2016/0286904 A1 Oct. 6, 2016

Related U.S. Application Data

(60) Provisional application No. 61/904,645, filed on Nov. 15, 2013.

(51) Int. Cl.
*A43B 5/00* (2006.01)
*A43C 15/00* (2006.01)
(Continued)

(52) U.S. Cl.
CPC ..... *A43C 15/02* (2013.01); *A43B 13/223* (2013.01); *A43C 15/161* (2013.01); *A43C 15/168* (2013.01)

(58) Field of Classification Search
CPC ..... A43B 13/22; A43B 13/223; A43B 13/26; A43C 15/00; A43C 15/02; A43C 15/16;
(Continued)

(56) References Cited

U.S. PATENT DOCUMENTS 2,222,650 A * 11/1940 Brady ..... A43C 15/168 36/59 R
2,584,182 A 2/1952 Bernstein
(Continued)

FOREIGN PATENT DOCUMENTS

DE 2313646 A1 * 10/1974 ..... A43C 15/16
DE 29807086 U1 * 7/1998 ..... A43B 13/26
(Continued)

OTHER PUBLICATIONS

International Searchng Authority, International Search Report and Written Opinion for PCT Application No. PCT/US2014/065377, dated Mar. 10, 2015.

*Primary Examiner* — Jameson D Collier
(74) *Attorney, Agent, or Firm* — Honigman LLP; Matthew H. Szalach; Jonathan P. O'Brien

(57) ABSTRACT

An article of footwear with self-cleaning cleats and a method of making an article of footwear. The article of footwear may include a sole plate having cleats associated with resilient members. The resilient members may be disposed on the cleats. The resilient members may prevent mud from accumulating on the cleats and/or a bottom surface of the sole plate by compressing against a surface of the ground and then springing back, preventing mud from sticking to the resilient member.

20 Claims, 14 Drawing Sheets

(51) Int. Cl.
*A43C 15/02* (2006.01)
*A43B 13/22* (2006.01)
*A43C 15/16* (2006.01)

(58) Field of Classification Search
CPC ... A43C 15/161; A43C 15/162; A43C 15/164; A43C 15/165; A43C 15/167; A43C 15/168
USPC ..... 36/134, 59 C, 67 A, 67 D, 67 R
See application file for complete search history.

(56) References Cited

U.S. PATENT DOCUMENTS 4,146,979 A * 4/1979 Fabbrie ..... A43C 15/167 36/127
4,271,608 A * 6/1981 Tomuro ..... A43C 15/165 36/127
4,466,205 A * 8/1984 Corbari ..... A43C 15/161 36/134
4,723,366 A 2/1988 Hagger
5,289,647 A * 3/1994 Mercer ..... A43C 15/168 36/134
6,021,590 A * 2/2000 Morimoto ..... A43C 15/14 36/127
6,442,872 B1 * 9/2002 Liao ..... A43C 15/161 36/114
6,698,110 B1 * 3/2004 Robbins ..... A43B 5/185 36/134
6,915,595 B2 * 7/2005 Kastner ..... A43C 15/005 36/59 C
8,056,267 B2 * 11/2011 Auger ..... A43B 5/02 36/114
8,176,660 B2 * 5/2012 Auger ..... A43B 1/0027 36/134
2003/0033731 A1 * 2/2003 Sizemore ..... A43B 13/182 36/28
2003/0093925 A1 * 5/2003 Auger ..... A43C 15/161 36/134
2009/0158622 A1 * 6/2009 Cook ..... A43B 1/0036 36/137
2010/0107450 A1 * 5/2010 Locke ..... A43C 15/168 36/134
2011/0023329 A1 2/2011 Auger et al.
2011/0061267 A1 * 3/2011 Dow ..... A43C 15/168 36/134
2015/0335095 A1 * 11/2015 Lee ..... A43B 5/00 36/59 C
2016/0058107 A1 * 3/2016 Walker ..... A43B 13/04 36/98
2016/0058109 A1 * 3/2016 Schiller ..... A43B 13/04 36/25 R
2016/0174655 A1 * 6/2016 Schiller ..... A43B 13/12 36/30 R
2016/0278484 A1 * 9/2016 Aslani ..... A43B 3/166
2016/0286905 A1 * 10/2016 Schiller ..... A43B 3/166
2017/0238654 A1 * 8/2017 Baghdadi ..... A43B 13/04

FOREIGN PATENT DOCUMENTS

EP 0223700 A1 * 5/1987 ..... A43B 5/001
EP 0356637 A1 * 3/1990 ..... A43C 15/167
EP 0356637 A1 3/1990
GB 2313999 A * 12/1997 ..... A43B 13/26
GB 2322534 A * 9/1998 ..... A43B 5/18

* cited by examiner

ARTICLE OF FOOTWEAR WITH SELF-CLEANING CLEATS

CROSS-REFERENCE TO RELATED APPLICATIONS

This application is the national phase of International Application No. PCT/US2014/065377, filed Nov. 13, 2014, which claims the benefit of U.S. Provisional Patent Application No. 61/904,645, filed Nov. 15, 2013, the disclosures of which are hereby incorporated by reference in their entirety.

FIELD

The present invention relates generally to an article of footwear and, more particularly, to a sports shoe with cleats.

BACKGROUND

Articles of footwear having cleats have previously been proposed. While conventional cleats generally help give sports shoes more grip, the cleats often accumulate mud when the article of footwear is worn in muddy conditions. In some instances, the mud accumulates on a shaft of the cleats and in the spaces surrounding the cleats and in between the cleats. The accumulation of mud weighs down the article of footwear and interferes with the traction between the cleats and the ground. It would be advantageous for a sports shoe to have cleats that prevent mud from accumulating around the cleats.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
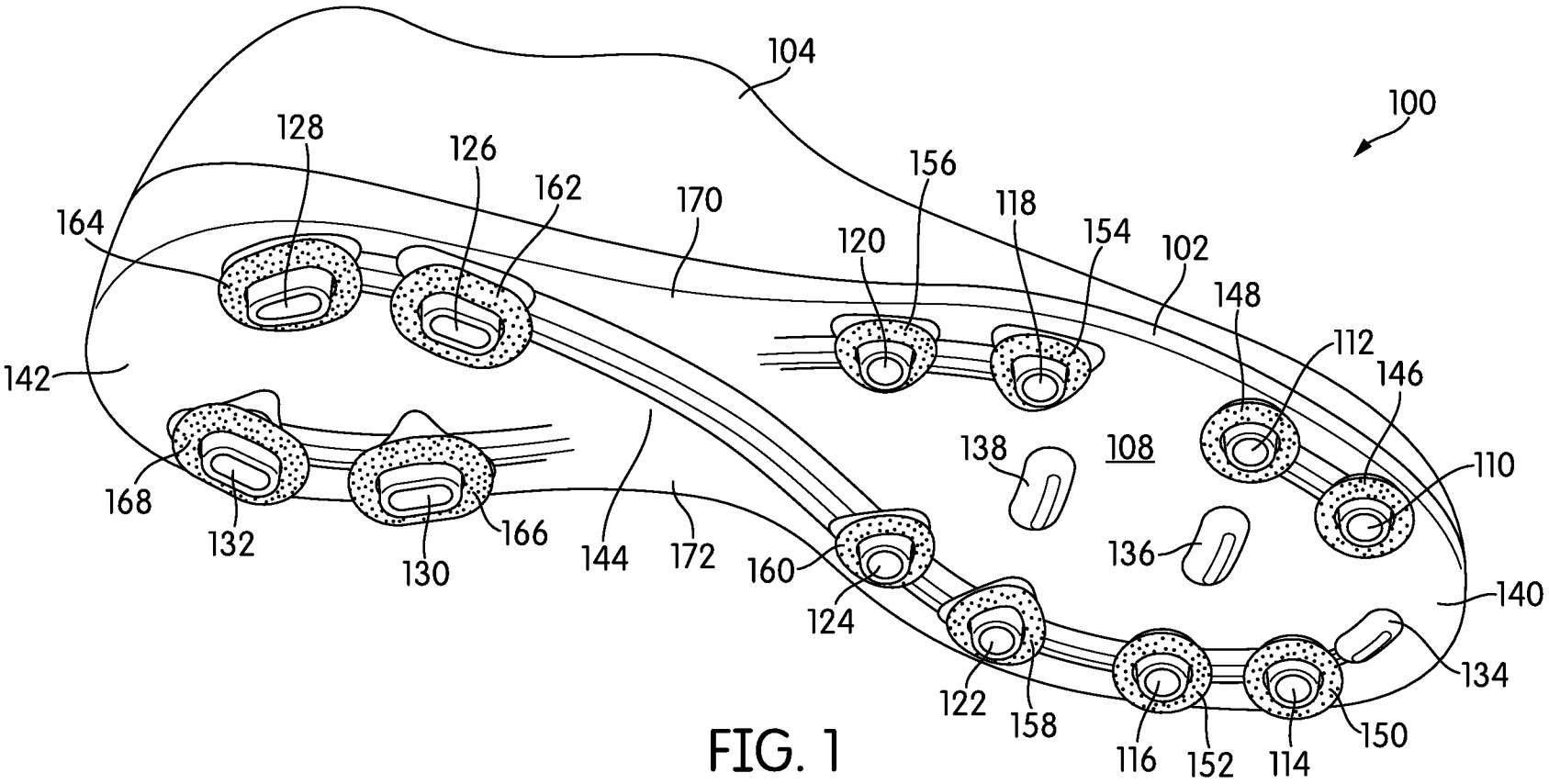
FIG. 1 is an isometric view of an exemplary embodiment of an article of footwear with a sole plate with cleats.

An article of footwear having self-cleaning cleats and a method of making an article of footwear are disclosed. The article of footwear may generally include a sole plate having cleats associated with resilient members. The resilient members may be disposed on a shaft of the cleats. The resilient members may prevent mud from accumulating on the cleats and/or bottom surface of the sole plate by compressing against a surface of the ground and then springing back, preventing mud from sticking to the resilient member.

In one aspect, the article of footwear may include a sole plate including a bottom surface having a forefoot region, a heel region, a longitudinal axis extending through the forefoot region and heel region, a forward edge, and a rearward edge. The article of footwear may include a first cleat disposed on the bottom surface of the sole plate. The first cleat may have a shaft extending away from the bottom surface of the sole plate and a terminal end disposed opposite the bottom surface of the sole plate. The article of footwear may include a first resilient member disposed on the shaft of the first cleat.

In some embodiments, the first resilient member may be a sheath that substantially surrounds a surface of the shaft of the first cleat.

In some embodiments, the first resilient member may have a substantially toroidal shape.

In some embodiments, the first resilient member may have a substantially circular cross section.

In some embodiments, the article of footwear may further include a second cleat disposed on the bottom surface of the sole plate. The second cleat may have a shaft extending away from the bottom surface of the sole plate and a terminal end disposed opposite the bottom surface of the sole plate. The article of footwear may further include a second resilient member may be disposed on the shaft of the second cleat.

In some embodiments, the first resilient member may be made from at least one of silicone and rubber.

In some embodiments, the article of footwear may include an upper attached to the sole plate.

In some embodiments, the first resilient member may be disposed on the shaft of the first cleat between the bottom surface of the sole plate and the terminal end of the first cleat.

In some embodiments, the first resilient member may be spaced from the bottom surface of the sole plate.

In some embodiments, the first resilient member may contact the shaft of the first cleat.

In some embodiments, the first resilient member may completely encircle a surface of the shaft of the first cleat.

In some embodiments, the first cleat may extend through an opening in the first resilient member such that the terminal end of the first cleat is exposed.

In some embodiments, the first resilient member may terminate at a point between the terminal end of the first cleat and a bottom surface of the sole plate.

In some embodiments, the first resilient member may substantially surround the shaft of the first cleat.

In some embodiments, the first resilient member may be disposed along an area where the bottom surface of the sole plate and the shaft of the first cleat meet.

In some embodiments, the first resilient member may be a sheath having a substantially uniform thickness.

In one aspect, a method of making an article of footwear may include providing a sole plate including a bottom surface having a forefoot region, a heel region, a longitudinal axis extending through the forefoot region and heel region, a forward edge, and a rearward edge. The sole plate may include a first cleat disposed on the bottom surface of the sole plate. The first cleat may have a shaft extending away from the bottom surface of the sole plate and a terminal end disposed opposite the bottom surface of the sole plate. The method may further include a step of placing a first resilient member on the shaft of the first cleat.

In some embodiments, the step of placing the first resilient member on the shaft of the first cleat may include placing the first resilient member around the shaft in a position disposed between the sole plate and the terminal end of the cleat.

In some embodiments, the step of placing the first resilient member on the shaft of the first cleat may include placing the first resilient member along an area where the bottom surface of the sole plate and the shaft of the first cleat meet.

In some embodiments, the method may further include a step of placing a second resilient member on the shaft of a second cleat of the sole plate.

Other systems, methods, features and advantages of the invention will be, or will become, apparent to one of ordinary skill in the art upon examination of the following figures and detailed description. It is intended that all such additional systems, methods, features and advantages be included within this description and this summary, he within the scope of the invention, and be protected by the following claims.

An article of footwear having self-cleaning cleats is disclosed. The article of footwear may include a sole plate having cleats associated with resilient members. For example, FIGS. 1-8 illustrate an exemplary embodiment of a sole plate 102 may include a first cleat 110 having a first resilient member 146. The resilient members associated with the cleats may prevent mud from accumulating on the cleats and/or a bottom surface of the sole plate by compressing against a surface of the ground and then springing back, preventing mud from sticking to the resilient member. For example, FIGS. 5-8 (described in more detail below) show resilient members before, during, and after being submerged in mud. Preventing mud from accumulating on the cleats may also prevent mud from accumulating in the area surrounding the cleats and in the spaces between the cleats.

The following detailed description discusses an exemplary embodiment in the form of soccer boots, but it should be noted that the present concept may be associated with any article of footwear, including, but not limited to, baseball shoes, rugby shoes, and football shoes. The articles of footwear shown in the figures may be intended to be used with a right foot. However, it should be understood that the following discussion may apply to mirror images of the articles of footwear that may be intended to be used with a left foot.

In some embodiments, the sole plate may be associated with an upper. For example, as shown in FIG. 1, sole plate 102 may be associated with upper 104. The upper may be attached to the sole plate by any known mechanism or method. For example, upper 104 may be stitched to sole plate 102 or upper 104 may be glued to sole plate 102. The upper may be configured to receive a foot. The exemplary embodiment shows a generic design for the upper. In some embodiments, the upper may include another type of design.

The sole plate and upper may be made from materials known in the art for making articles of footwear. For example, the sole plate may be made from elastomers, siloxanes, natural rubber, synthetic rubbers, aluminum, steel, natural leather, synthetic leather, plastics, or thermoplastics. In another example, the upper may be made from nylon, natural leather, synthetic leather, natural rubber, or synthetic rubber.

The sole plate may have a top surface and a bottom surface. For example, referring to FIGS. 1-8, sole plate 102 may include a top surface 306 and a bottom surface 108. The sole plate may be configured to be attached to the upper. The sole plate may also be configured to be attached to a midsole or an insole of an article of footwear. The top surface may be configured to contact the midsole or the insole. The sole plate may include a forefoot region disposed proximate a wearer's forefoot. For example, sole plate 102 may include a forefoot region 140. The sole plate may include a heel region disposed proximate a wearer's heel and opposite the forefoot region. For example, sole plate 102 may include a heel region 142. The sole plate may include a midfoot region disposed between the forefoot region and the heel region. For example, sole plate 102 may include a midfoot region 144. The sole plate may include a medial side and a lateral side opposite medial side. For example, sole plate 102 may include a medial side 172 and a lateral side 170. The sole plate may include a forward edge and a rearward edge disposed opposite the forward edge.

The bottom surface of the sole plate may be configured to contact a playing surface. For example, the bottom surface may be configured to contact grass, synthetic turf, dirt, or sand. The bottom surface of the sole plate may include provisions for increasing traction with such a playing surface. For example, as shown in FIGS. 1-8, such provisions may include cleats. First cleat 110, a second cleat 112, a third cleat 114, a fourth cleat 116, a fifth cleat 118, a sixth cleat 120, a seventh cleat 122, and a eighth cleat 124 may be disposed on forefoot region 140 of sole plate 102. A ninth cleat 126, a tenth cleat 128, an eleventh cleat 130, and a twelfth cleat 132 may be disposed on heel region 142 of sole plate 102. A thirteenth cleat 134, a fourteenth cleat 136, and a fifteenth cleat 138 may be disposed on forefoot region 140 of sole plate 102.

In some embodiments, the sole plate may include cleats that extend from the bottom surface. For example, as shown in FIGS. 1-8, sole plate 102 may include cleats integrally formed with sole plate 102 through molding. In another example, the sole plate may be configured to receive cleats. In some embodiments, the sole plate may include cleat receiving members configured to receive removable cleats. For example, the cleat receiving members may include threaded holes and the cleats may screw into the threaded holes. In some embodiments, the cleat receiving members may be raised with respect to the sole plate. In other embodiments, the cleat receiving members may be flush with the bottom surface of the sole plate.

The cleats may be made from materials known in the art for making articles of footwear. For example, the cleats may be made from elastomers, siloxanes, natural rubber, synthetic rubbers, aluminum, steel, natural leather, synthetic leather, plastics, or thermoplastics. In some embodiments, the cleats may be made of the same materials. In other embodiments, the cleats may be made of various materials. For example, first cleat 110 may be made of aluminum while second cleat 112 is made of a thermoplastic material.

The cleats may have any type of shape. In some embodiments, the cleats may all have the same shape. In other embodiments, at least one of the cleats may have a different shape from another cleat. For example, in the exemplary embodiment shown in FIGS. 1-8, first cleat 110 may be shaped differently from ninth cleat 126. In some embodiments, the cleats may have a first set of identically shaped cleats, a second set of identically shaped cleats, and/or a third set of identically shaped cleats. For example, as shown in FIGS. 1-8, first cleat 110, second cleat 112, third cleat 114, fourth cleat 116, fifth cleat 118, sixth cleat 120, seventh cleat 122, and eighth cleat 124 may make up a first set of cleats having a first shape, while ninth cleat 126, tenth cleat 128, eleventh cleat 130, and twelfth cleat 132 may make up a second set of cleats having a second shape, and thirteenth cleat 134, fourteenth cleat 136, and fifteenth cleat 138 may make up a third set of cleats having a third shape.

Figure 2:
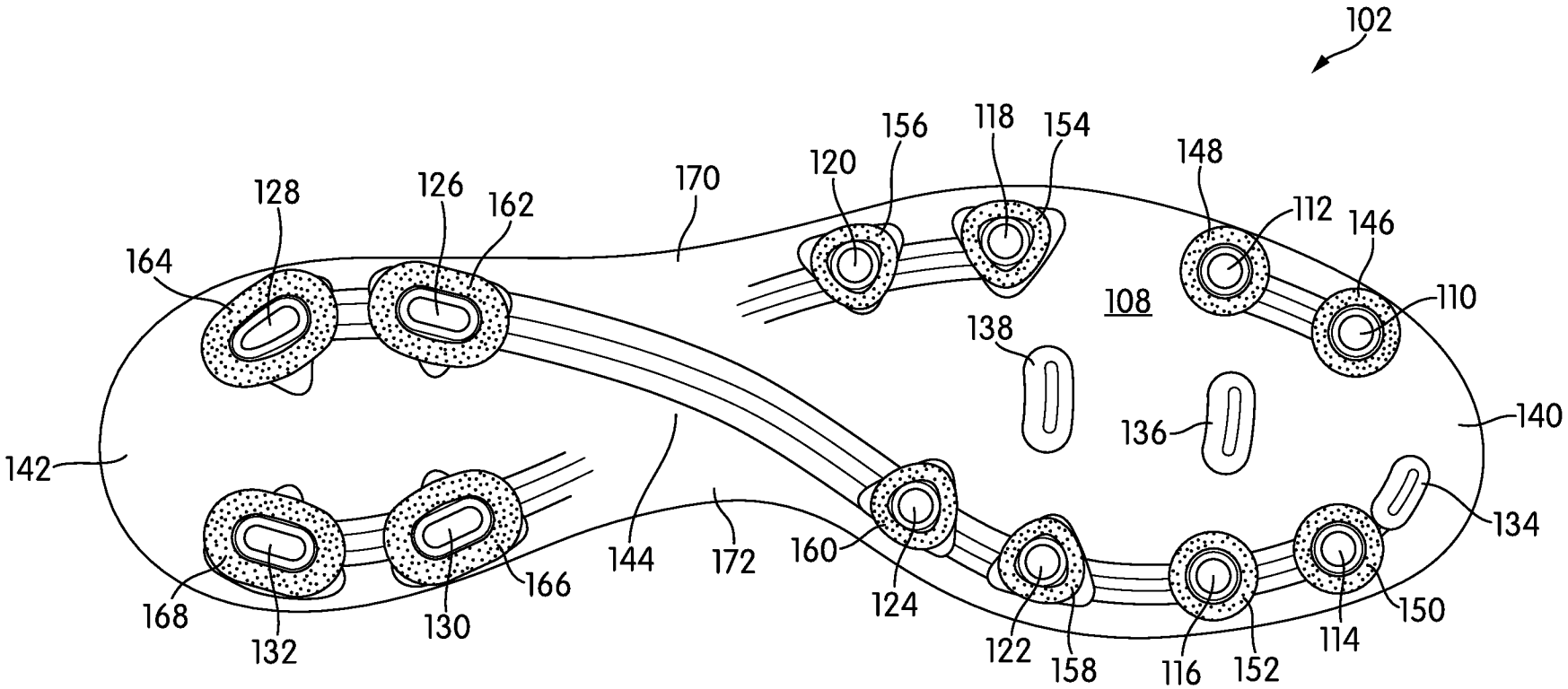
FIG. 2 is a plane view of the sole plate of FIG. 1.
Figure 3:
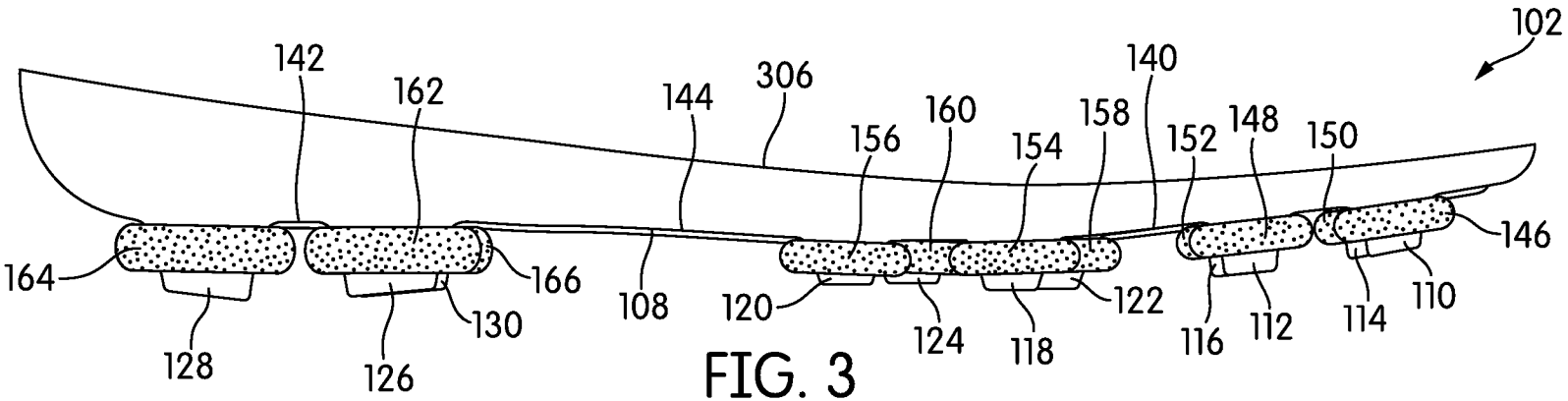
FIG. 3 is a side view of the sole plate of FIG. 1 from a lateral side.
Figure 4:
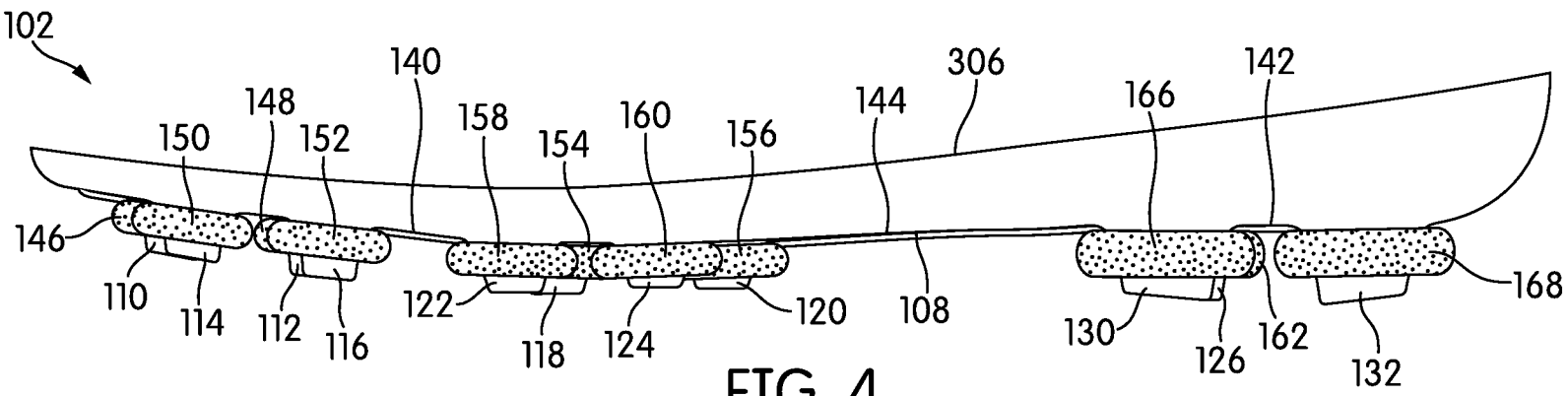
FIG. 4 is a side view of the sole plate of FIG. 1 from a medial side.
Figure 6:
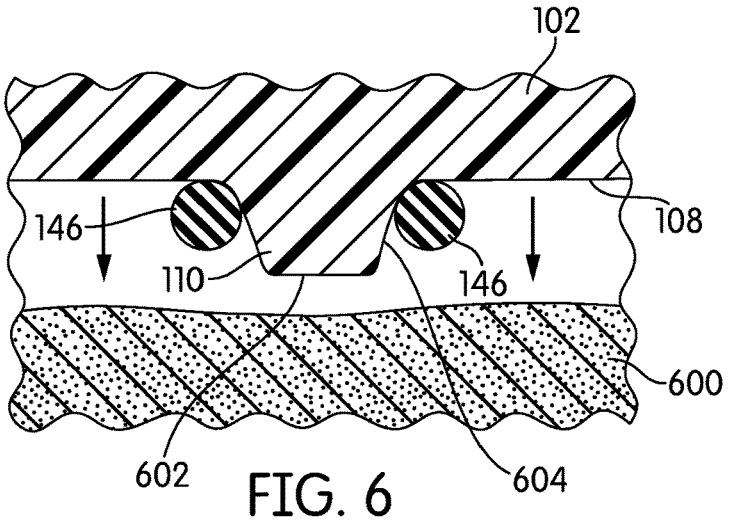
FIG. 6 is a side view of the first cleat of the sole plate of FIG. 1 before being submerged in mud.
Figure 7:
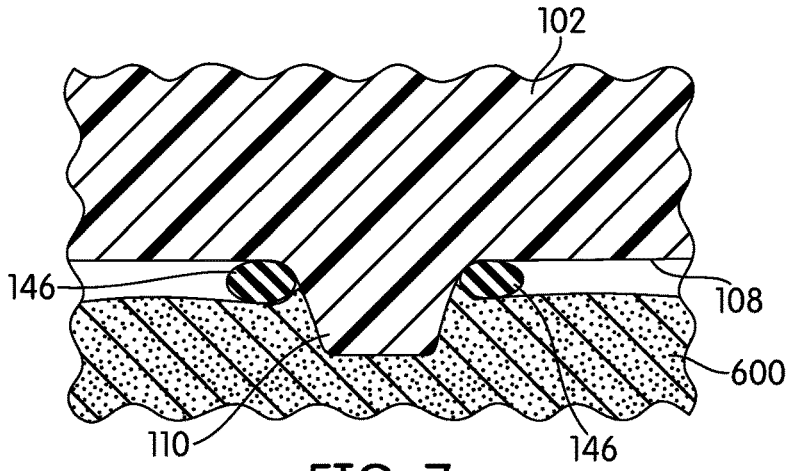
FIG. 7 is a side view of the first cleat of the sole plate of FIG. 1 being submerged in mud.
Figure 8:
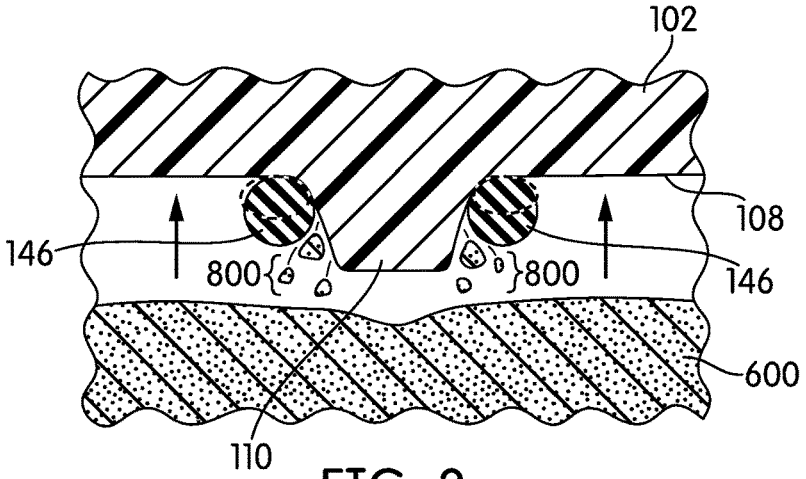
FIG. 8 is a side view of the first cleat of the sole plate of FIG. 1 after being submerged in mud.

The cleats may have a shaft extending away from the bottom surface of the sole plate. The shaft may have a surface. The cleats may have a terminal end that is disposed opposite the bottom surface of the sole plate. For example, as shown in the zoomed in side view of first cleat 110 in FIGS. 6-8, first cleat 110 may have a shaft 604 and a terminal end 602. In another example, as shown in the zoomed in side view of first cleat 910 in FIGS. 14-16, first cleat 910 may have a shaft 1404 and a terminal end 1402. In some embodiments, the shaft of at least one cleat may be round. For example, as shown in FIG. 2, the shaft of at least one cleat may form a circular shape (first cleat 110) or an oval shape (ninth cleat 126). A surface of the round shaft may formed by a single sidewall. In other embodiments, at least one of the cleats may be a shaft formed from a plurality of sidewalls. For example, a cleat may have three sidewalls forming a triangular shaped shaft. In another example, a cleat may have four sidewalls forming a square shaped shaft or a rectangular shaped shaft. In some examples, the shaft of the cleat may taper along the direction from the bottom surface of the sole plate to the terminal end, as shown in FIGS. 6-8 and 14-16. The terminal end of at least one cleat may be a substantially flat surface. For example, as shown in FIGS. 6-8, terminal end 602 may be a substantially fiat surface. In some embodiments, a substantially flat surface of the terminal end of at least one cleat may be substantially parallel with the bottom surface of the sole plate. In some embodiments, a substantially flat surface of the terminal end of the at least one cleat may be substantially angled with respect to the bottom surface of the sole plate. In other embodiments, the terminal end of at least one cleat may have other shapes that are not substantially flat. For example, the terminal end of the cleat may be a substantially rounded surface. In another example, the terminal end of the cleat may be a surface having ridges. In yet another example, the terminal end of the cleat may be substantially conical.

In some embodiments, the cleats may have the same height, width, and/or thickness as each other. In other embodiments, the cleats may have different heights, different widths, and/or different thicknesses from each other. In some embodiments, a first set of cleats may have the same height, width, and/or thickness as each other, while a second set of cleats may have a different height, width, and/or thickness from the first set of cleats. For example, as shown in FIGS. 1-8, first cleat 110, second cleat 112, third cleat 114, fourth cleat 116, fifth cleat 118, sixth cleat 120, seventh cleat 122, and eighth cleat 124 may make up a first set of cleats having a first width and/or thickness, while ninth cleat 126, tenth cleat 128, eleventh cleat 130, and twelfth cleat 132 may make up a second set of cleats having a second width and/or thickness.

The cleats may be arranged in any cleat pattern on the sole plate. For example, as shown in FIGS. 1-2, first cleat 110, second cleat 112, fifth cleat 118, and sixth cleat 120 may be substantially aligned with one another adjacent a lateral perimeter of bottom surface 108 of sole plate 102 in forefoot region 140. Similarly, in some embodiments, third cleat 114, fourth cleat 116, seventh cleat 122, and eighth cleat 124 may be substantially aligned with one another adjacent a medial perimeter of bottom surface 108 of sole plate 102 in heel region 142. In some embodiments, ninth cleat 126 and tenth cleat 128 may be substantially aligned with one another along the lateral perimeter of bottom surface 108 of sole plate 102 in heel region 142. In some embodiments, eleventh cleat 130 and twelfth cleat 132 may be substantially aligned with one another along the medial perimeter of bottom surface 108 of sole plate 102 in heel region 142. In some embodiments, fourteenth cleat 136 and fifteenth cleat 138 may be disposed in a forefoot region 140 of sole plate 102 substantially along a centerline of bottom surface 108 of sole plate 102. While the embodiments of FIGS. 1-19 are all illustrated with the same cleat pattern (arrangement), it is understood that other cleat patterns may be used with the sole plate. The arrangement of the cleats may enhance traction for a wearer during cutting, turning, stopping, accelerating, and backward movement.

The sole plate may include components other than cleats that contact a playing surface and increase traction. In some embodiments, the sole plate may include traction elements that are smaller than cleats or studs. The traction elements on the sole plate may increase control for wearer when maneuvering forward on a surface by engaging surface. Additionally, traction elements may also increase the wearer's stability when making lateral movements by digging into playing surface. In some embodiments, the traction elements may be molded into the sole plate. In some embodiments, the sole plate may be configured to receive removable traction elements.

Figure 17:
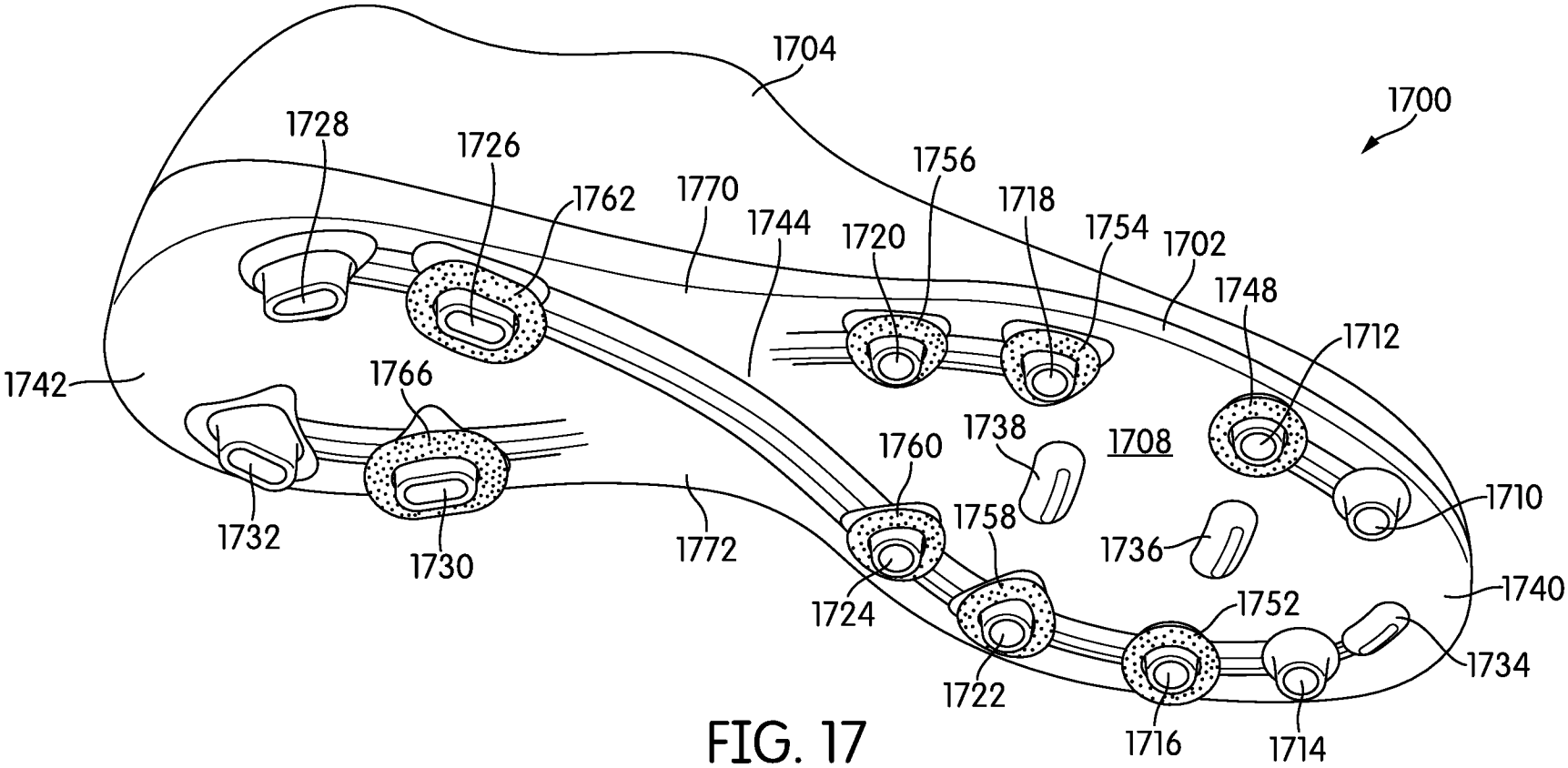
FIG. 17 is an isometric view of an exemplary embodiment of an article of footwear with a sole plate with cleats.

As previously stated, a resilient member may be disposed on the cleats. In some embodiments, a resilient member may be disposed on a shaft of at least one cleat. For example, as shown in FIGS. 1-8, first resilient member 146 may be disposed on shaft 604 of first cleat 110. In some embodiments, multiple cleats may have a resilient member disposed thereon. For example, as shown in FIGS. 1-8, a plurality of cleats may have a resilient member disposed thereon. The number of cleats having a resilient member disposed thereon may vary. For example, in the embodiment shown in FIGS. 1-8, all of the cleats disposed along the perimeter of bottom surface 108 of sole plate 102 have a resilient member disposed thereon. Yet in the embodiment shown in FIG. 17 (described in more detail below), the front two cleats (first cleat 1710 and third cleat 1714) and the back two cleats (tenth cleat 1728 and twelfth cleat 1732), which are all disposed along the perimeter of a bottom surface 1708 of a sole plate 1702 do not include resilient members. FIG. 17 is merely exemplary. In other embodiments, cleats other than the two front most cleats on the lateral and medial sides and the backmost two cleats may lack resilient members. The number of cleats having resilient members may vary depending upon a variety of factors, e.g. the size, shape, and/or pattern of the cleats. While not shown, in other embodiments, a resilient member may be disposed on thirteenth cleat 134, fourteenth cleat 136, and/or fifteenth cleat 138.

In some embodiments, at least one resilient member may be disposed on the surface of the shaft of at least one cleat. As shown in FIGS. 1-8, a first resilient member 146 may be disposed on first cleat 110. A second resilient member 148 may be disposed on second cleat 112. A third resilient member 150 may be disposed on third cleat 114. A fourth resilient member 152 may be disposed on fourth cleat 116. A fifth resilient member 154 may be disposed on fifth cleat 118. A sixth resilient member 156 may be disposed on sixth cleat 120. A seventh resilient member 158 may be disposed on seventh cleat 122. An eighth resilient member 160 may be disposed on eighth cleat 124. A ninth resilient member 162 may be disposed on ninth cleat 126. A tenth resilient member 164 may be disposed on tenth cleat 128. An eleventh resilient member 166 may be disposed on eleventh cleat 130. A twelfth resilient member 168 may be disposed on twelfth cleat 132.

Figure 10:
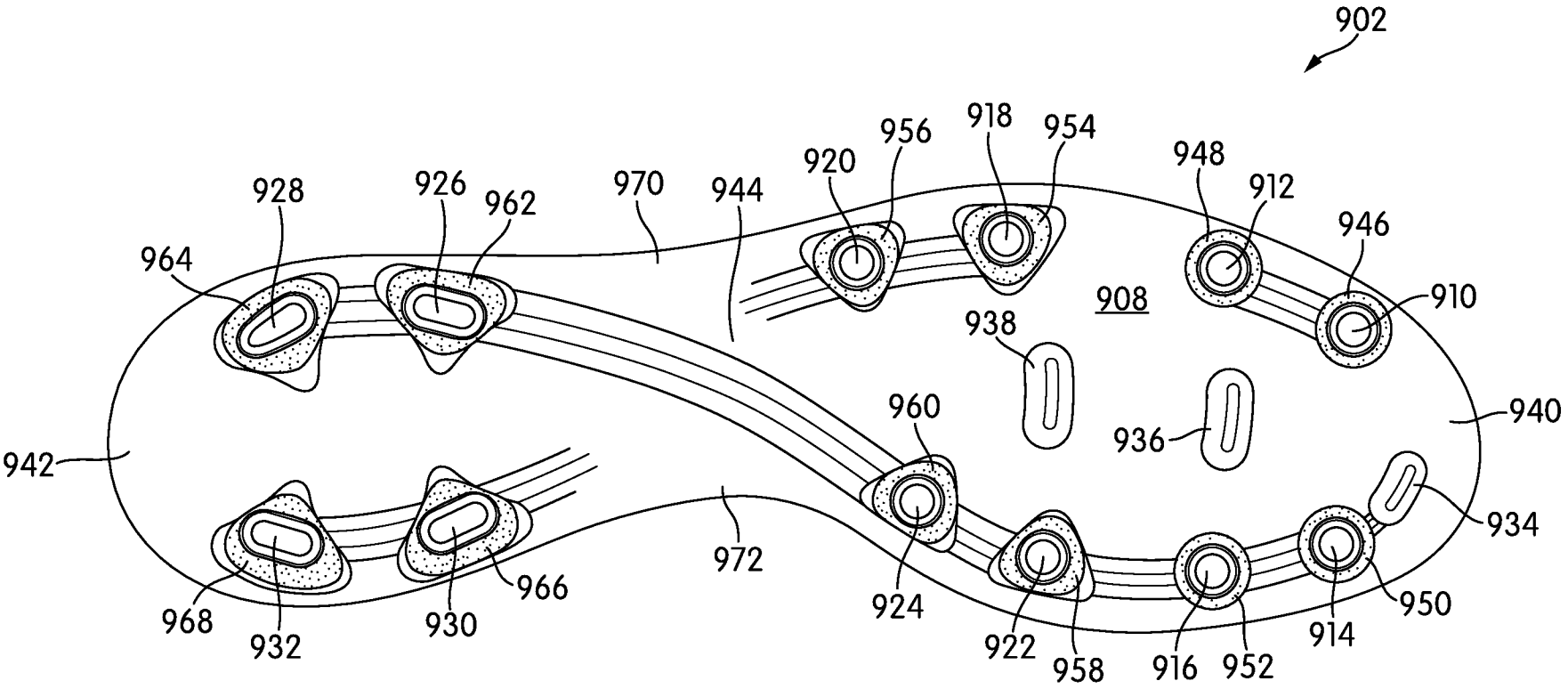
FIG. 10 is a plane view of the sole plate of FIG. 9.
Figure 11:
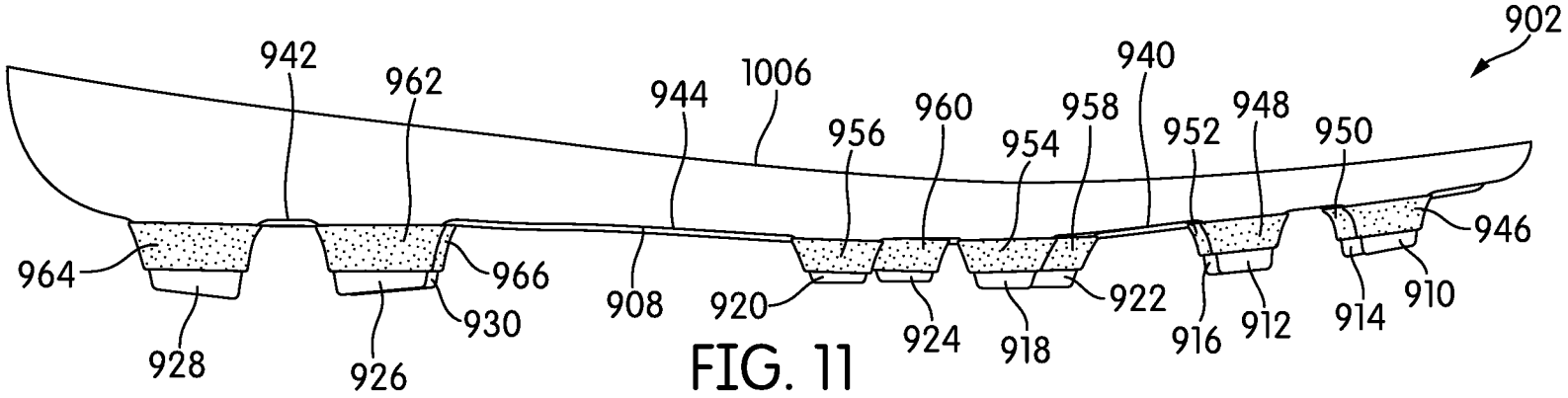
FIG. 11 is a side view of the sole plate of FIG. 9 from a lateral side.
Figure 12:
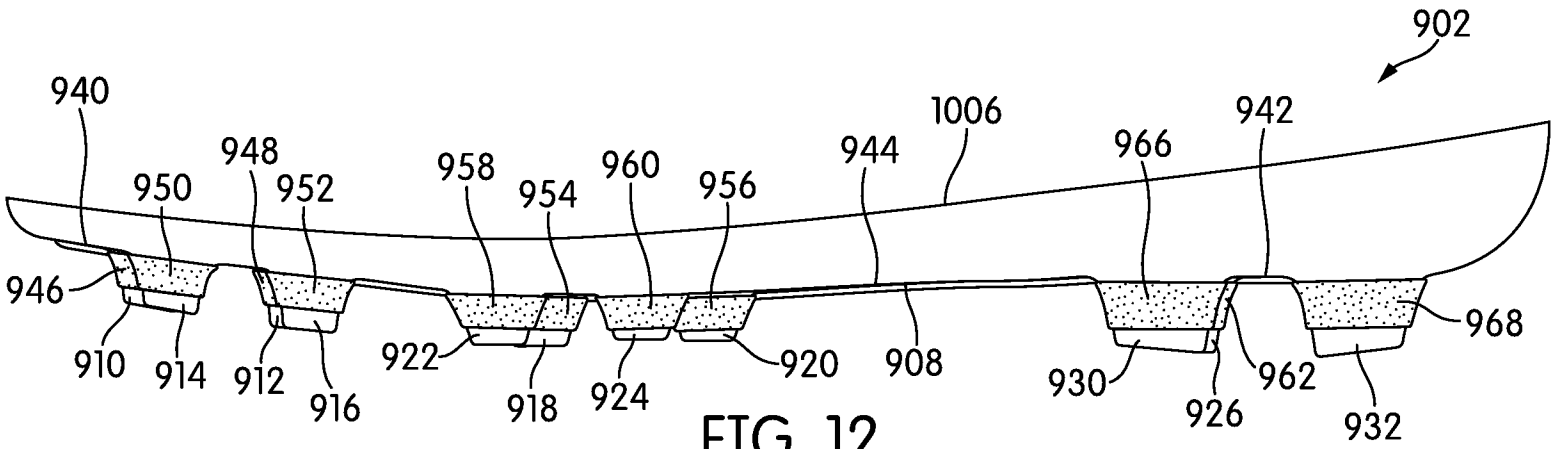
FIG. 12 is a side view of the sole plate of G. 9 from a medial side.

In some embodiments, at least one resilient member may substantially surround (encircle) the surface of the shaft. For example, as shown in FIG. 2, first resilient member 146 may substantially surround the surface of the shaft of first cleat 110. More specifically, first resilient member 146 may completely encircle the shaft of the first cleat 110. In another example, as shown in FIG. 10, second resilient member 948 may substantially surround the surface of the shaft of second cleat 912. In some embodiments, a resilient member may be disposed on the shaft of the first cleat between the bottom surface of the sole plate and the terminal end of the cleat. For example, as shown in FIGS. 3, 4, and 6-8, first resilient member 146 may be disposed on shaft 604 of first cleat 110 between bottom surface 108 of sole plate 102 and terminal end 602 of first cleat 110. In another example, as shown in FIGS. 11, 12, and 14-16, first resilient member 910 may be disposed on shaft 1404 of first cleat 910 between bottom surface 908 of sole plate 902 and terminal end 1402 of first cleat 910.

In some embodiments, a resilient member may contact the bottom surface of the sole plate. For example, as shown in FIGS. 3, 4, and 6-8, first resilient member 146 may contact bottom surface 108 of sole plate 102. In another example, as shown in FIGS. 11, 12, and 14-16, first resilient member 946 may contact bottom surface 908 of sole plate 902.

In some embodiments, a resilient member may contact the shaft of the sole plate. For example, as shown in FIGS. 3, 4, and 6-8, first resilient member 146 may contact shaft 604 of sole plate 102. In another example, as shown in FIGS. 11, 12, and 14-16, first resilient member 946 may contact shaft 1404 of sole plate 902.

Figure 5:
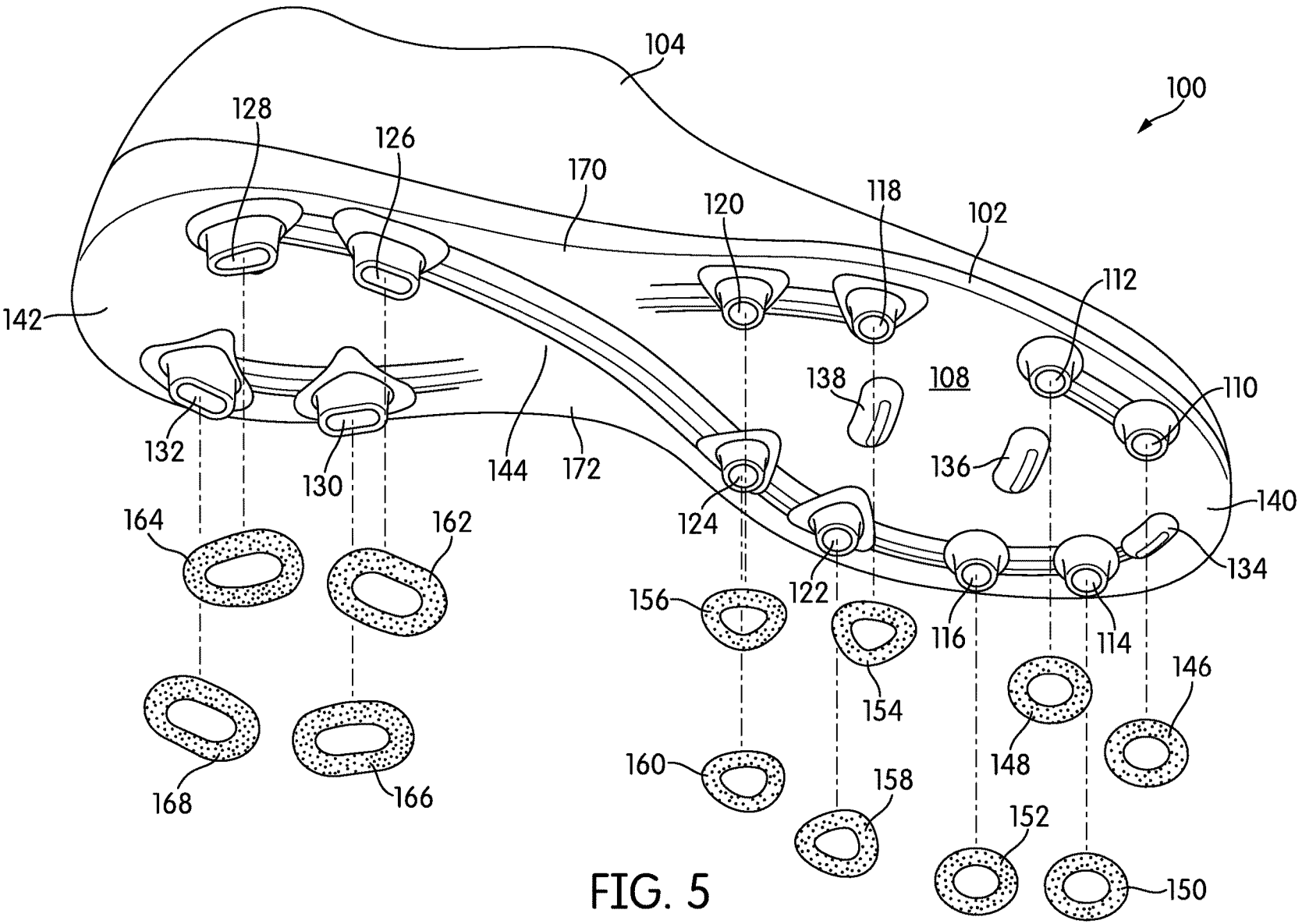
FIG. 5 is an exploded view of the sole plate of FIG. 1.
Figure 9:
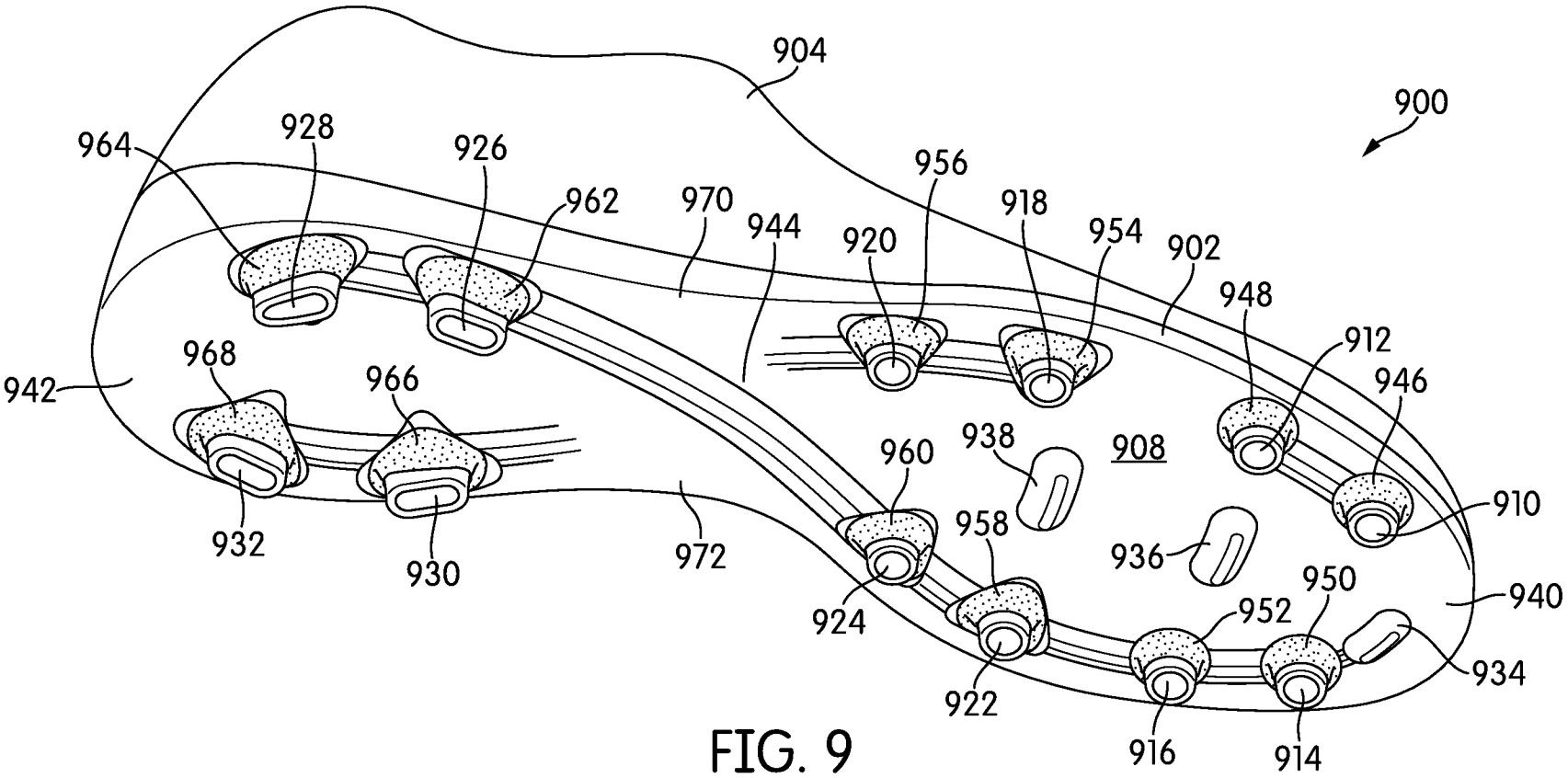
FIG. 9 is an isometric view of an exemplary embodiment of an article of footwear with a sole plate with cleats.
Figure 13:
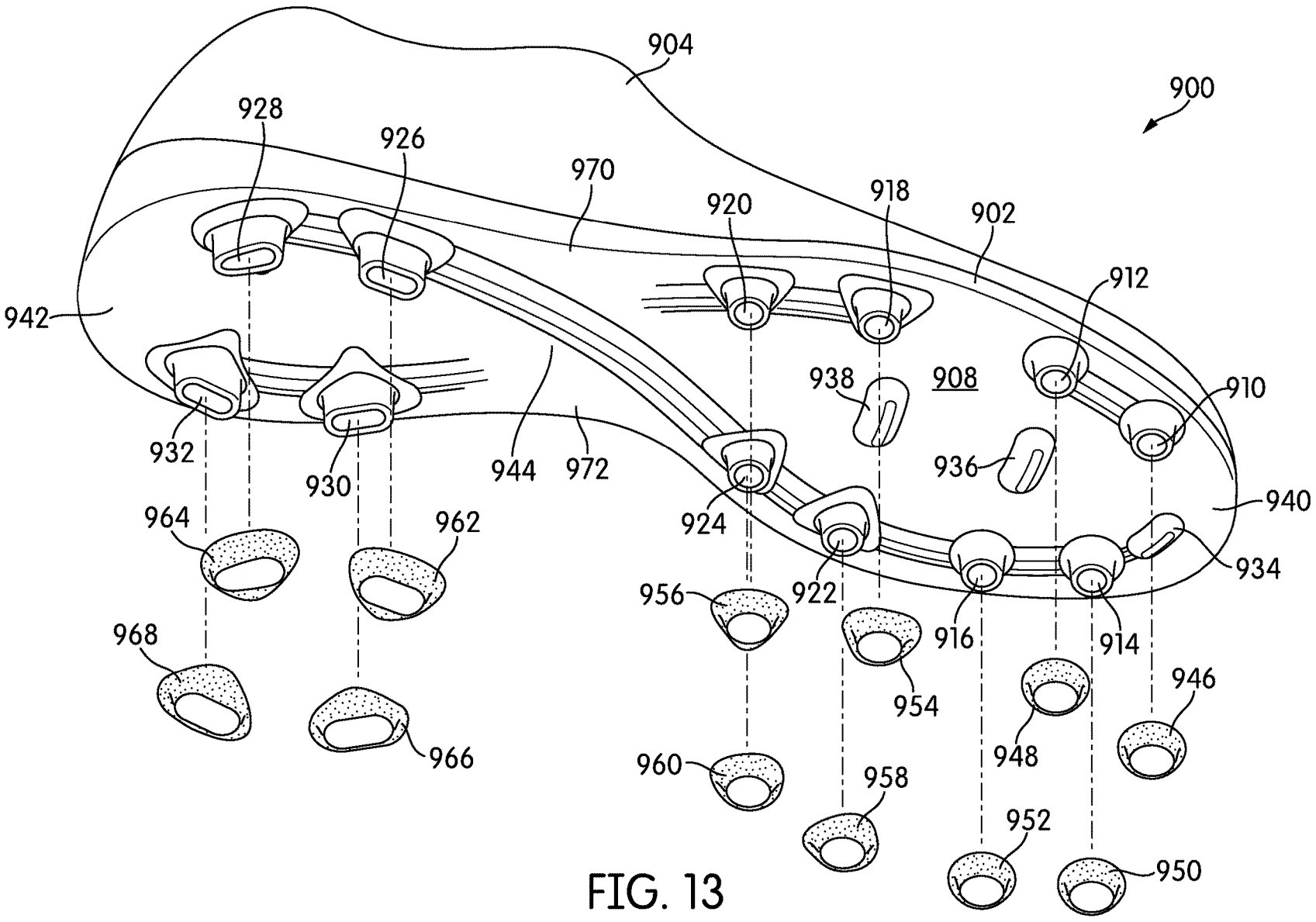
FIG. 13 is an exploded view of the sole plate of FIG. 9.

In some embodiments, at least one cleat may extend through an opening in at least one resilient member such that the terminal end of the cleat is exposed. For example, as shown in FIGS. 1-2 and 5, first cleat 110 may extend through an opening in first resilient member 146 such that terminal end 602 of first cleat 110 is exposed. In another example, as shown in FIGS. 9-10, and 13, first cleat 910 may extend through an opening in first resilient member 946 such that terminal end 1402 of first cleat 910 is exposed.

In some embodiments, at least one resilient member may terminate at a point between the terminal end of the first cleat and a bottom surface of the sole plate. For example, as shown in FIGS. 3, 4, and 6-8, first resilient member 146 may terminate at a point between terminal end 602 of first cleat 110 and bottom surface 108 of sole plate 102. In another example, as shown in FIGS. 11, 12, and 14-16, first resilient member 946 may terminate at a point between terminal end 1402 of first cleat 910 and bottom surface 908 of the sole plate 902. The resilient member may be shaped to correspond with the point between the terminal end of the cleat and the bottom surface of the sole plate such that the resilient member fits flush with this point.

In some embodiments, at least one resilient member may be disposed along an area where the bottom surface of the sole plate and the shaft of the first cleat meet. For example, as shown in FIGS. 3, 4, and 6-8, first resilient member 146 may be disposed along an area where bottom surface 108 of sole plate 102 and shaft 604 of first cleat 110 meet. In another example, as shown in FIGS. 11, 12, and 14-16, first resilient member 946 may be disposed along an area where bottom surface 908 of sole plate 902 and shaft 1404 of first cleat 910 meet.

Figure 16:
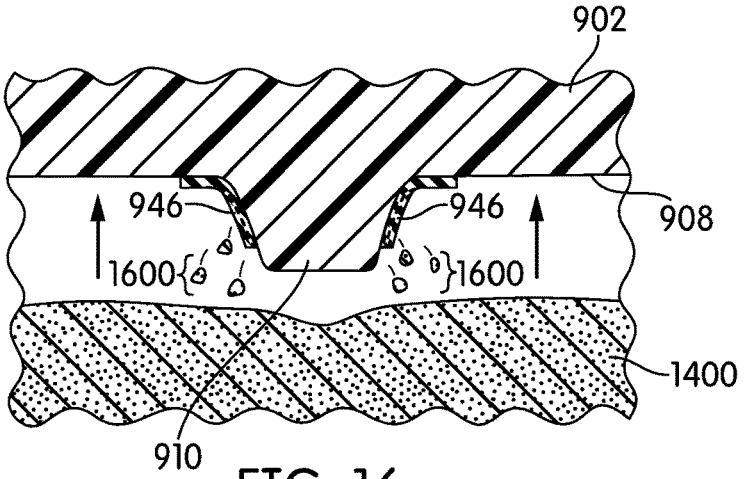
FIG. 16 is a side view of the first cleat of the sole plate of FIG. 9 after being submerged in mud.

The resilient members may have a variety of shapes. For example, as shown in FIGS. 1-8, the resilient members may have a substantially toroidal shape with a substantially circular cross section. In other embodiments, the resilient members may have a toroidal shape with another type of cross section. For example, the resilient members may have a toroidal shape with a rectangular cross section. In another example, the resilient members may have a toroidal shape having a semicircular cross section. In such an embodiment, the flat portion of the semicircular cross section may be disposed against the shaft of the cleat. In yet another example, as shown in FIGS. 16, the resilient members may be sheaths having a substantially uniform thickness. The shape and size of the resilient members may be selected based on a variety of factors. For example, the shape and size of the resilient members may be selected based on the shape and size of the cleats or the material used to make the resilient members.

Figure 18:
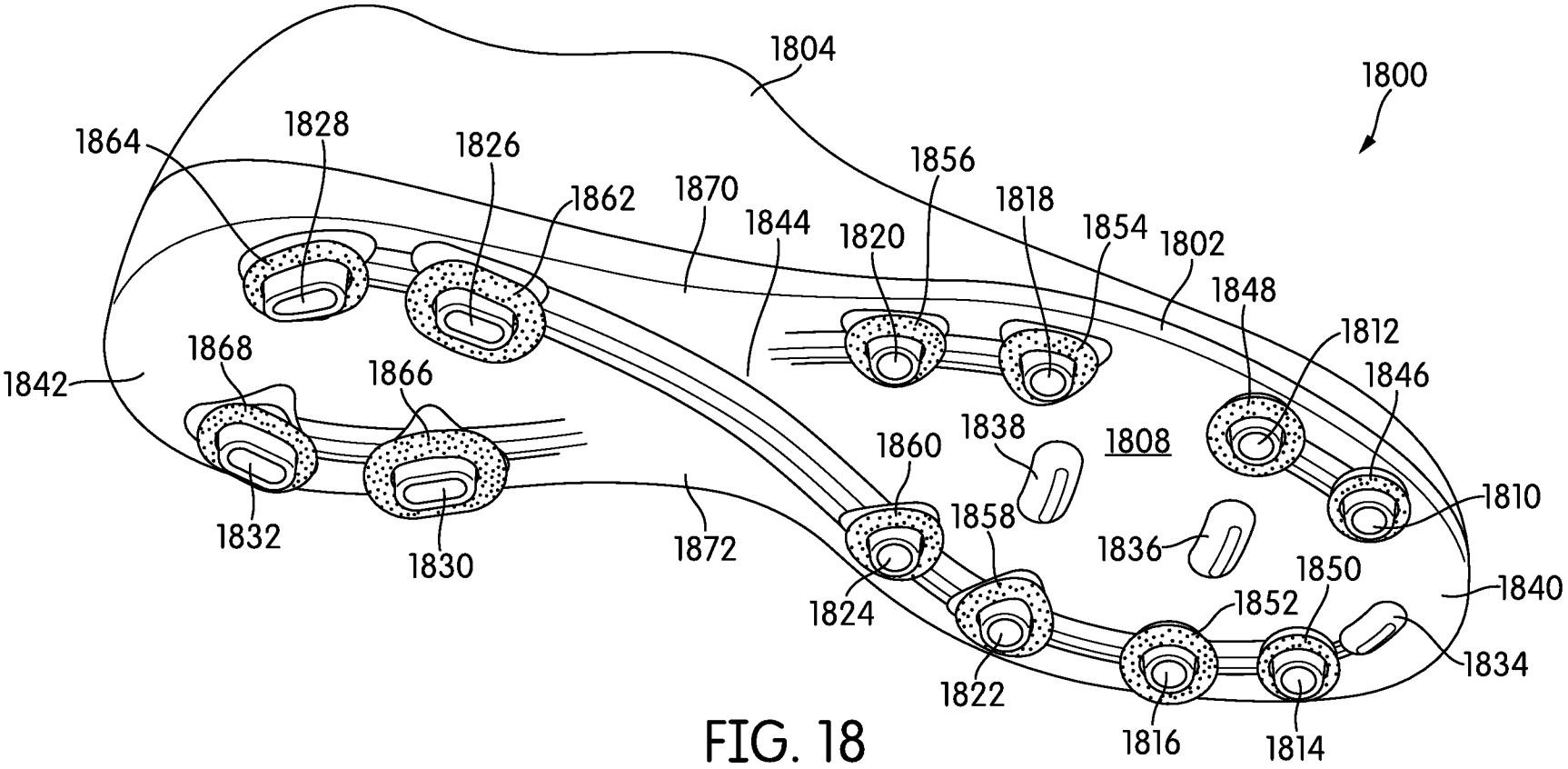
FIG. 18 is an isometric view of an exemplary embodiment of an of footwear with a sole plate with cleats.

In some embodiments, all of the resilient members may have the same size as each other. In other embodiments, at least a first resilient member may have a first size and at least a second resilient member may have a second size. For example, as shown in FIG. 18 (described in more detail below), first cleat 1810, third cleat 1814, tenth cleat 1828, and twelfth cleat 1832 may have resilient members that are smaller than the resilient members of the remaining cleats.

Figure 19:
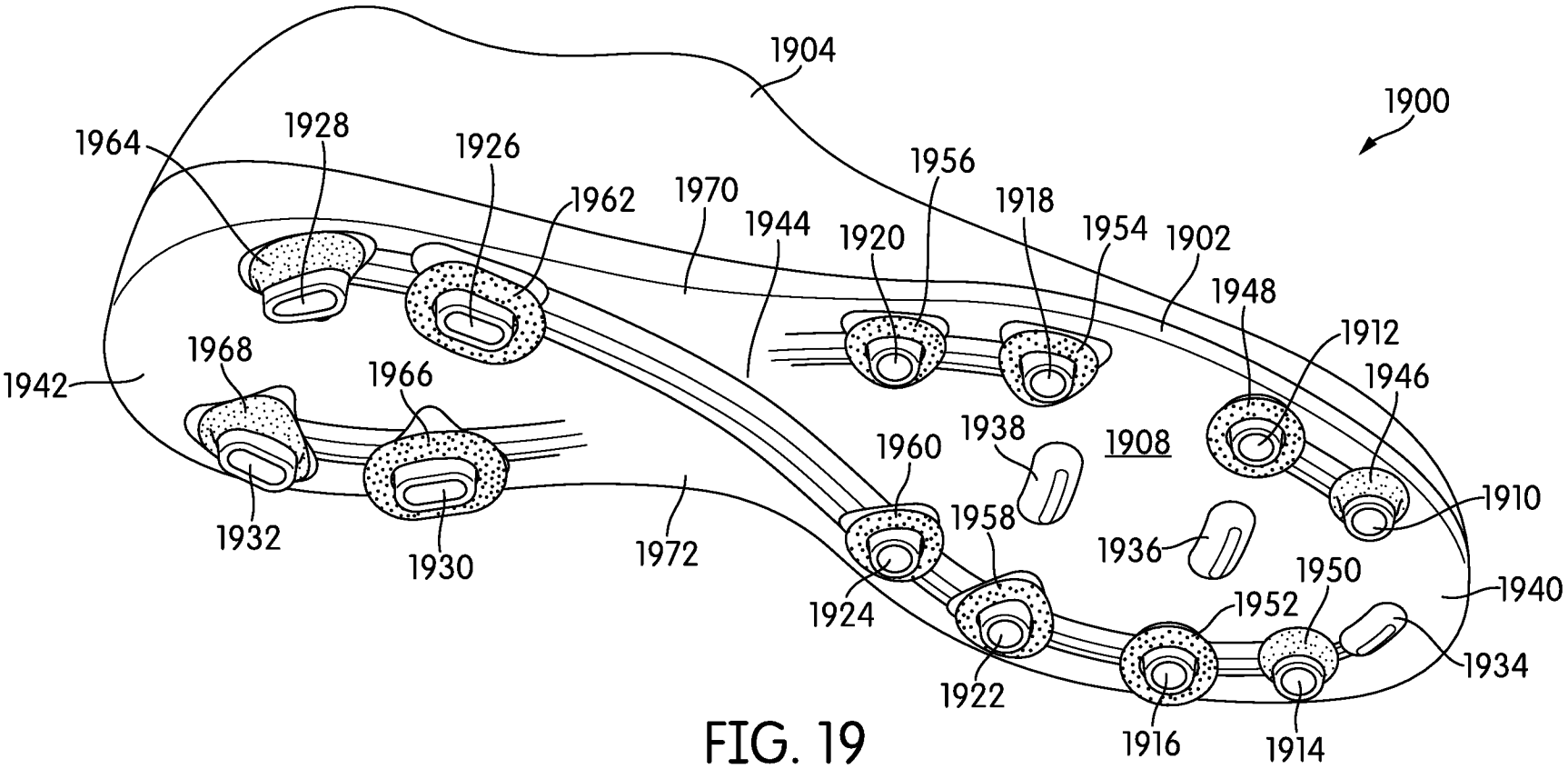
FIG. 19 is an isometric view of an exemplary embodiment of an article of footwear with a sole plate with cleats.

In some embodiments, all of the resilient members may have the same shape as each other. In other embodiments, at least a first resilient member may have a first shape and at least a second resilient member may have a second shape. For example, as shown in FIG. 19 (described in more detail below), first resilient member 1946 may be a sheath while the second resilient member 1948 may be a torpid. In some embodiments, a first set of resilient members may have a first shape while the remaining resilient members have a second shape. For example, as shown in FIG. 19, a first set of resilient members including first resilient member 1946, third resilient member 1950, tenth resilient member 1964, and twelfth resilient member 1968 may have resilient members that are sheaths while the remaining cleats have resilient members that have a toroidal shape.

The resilient members may be made of any resilient material. In some embodiments, to prevent water and/or mud from penetrating the resilient members, the resilient members may be made of a hydrophobic and/or oleophobic material. For example, the resilient members may be made of rubber, silicone, and/or latex. The material of the resilient members may be selected based on a variety of factors. For example, the material of the resilient members may be selected based on the material of the cleats or the shape of the resilient members. The material of the resilient members may be selected to retain the resilient members on the cleats.

In some embodiments, the resilient members are retained on the sole plate mechanically. For example, the resilient members may be retained on the cleats by friction. Such resilient members may be stretched around the sidewall of the cleats such that the elastic force of the resilient member and the friction between the resilient member and the cleats prevents the resilient members from slipping off of the cleats. In some embodiments, the inner surface of the resilient member may be textured to prevent slippage between the resilient member and the shaft of the cleat. In another example, the cleats may include a groove around the sidewall of the cleats that corresponds in shape to the resilient members. Such a groove may receive and retain the resilient members.

In some embodiments, the resilient members may be attached to and retained on the cleats by an adhesive. For example, in some embodiments, a resilient member may be affixed to the shaft of a cleat an adhesive. In some embodiments, the resilient member(s) may be affixed to the shafts of cleats by thermal bonding. For example, the resilient member and/or the shaft of the cleat may be heated to slightly soften and then the resilient member and the shaft of the cleat may be pressed together to fuse the two parts together. In some embodiments, the resilient member may be molded to the cleats. In some embodiments, the above methods of affixing the resilient members to the cleats can be combined. For example, a first resilient member may be affixed to a cleat by both thermal bonding and adhesive. Permanently affixing resilient member(s) to the cleat may prevent resilient member(s) from becoming detached from the bottom surface and may prevent mud and other debris from coming between the resilient member(s) and the cleat. In another example, a first resilient member may be retained on a first cleat by both friction and adhesive. In another example, a first resilient member may be retained on a first cleat by friction and a second resilient member may be retained on a second cleat by adhesive.

Figure 20:
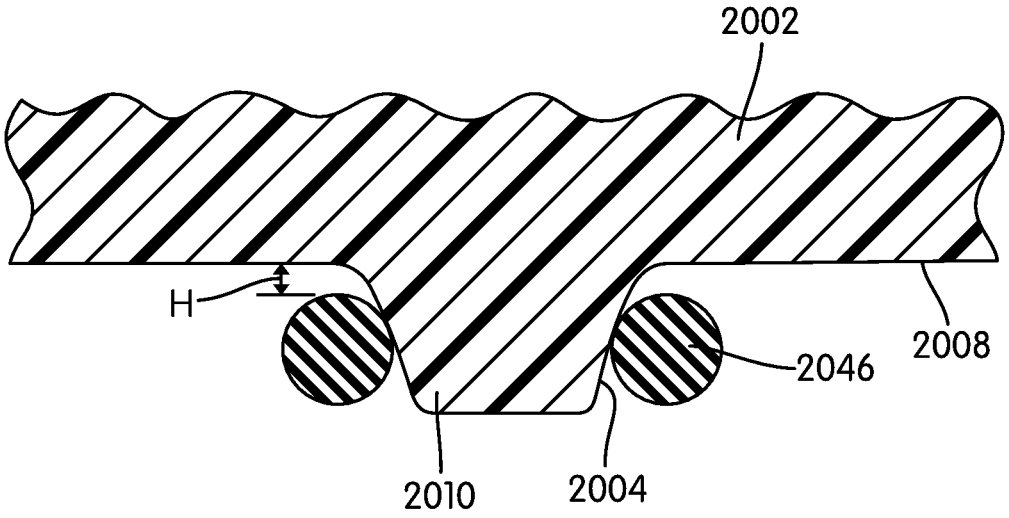
FIG. 20 shows a cross section of a portion of an exemplary embodiment of an article of footwear with a sole plate with cleats.

In some embodiments, the resilient members may be attached to the cleat without being attached to the bottom surface of the sole plate. For example, as shown in FIGS. 1-8, first resilient member 110 may contact bottom surface 108 of sole plate 102 without being attached to bottom surface 108. In another example, as shown in FIG. 20, a sole plate 2002 may have a bottom surface 2008 from which a cleat 2010 having a shaft 2004 and a terminal end 2002 may extend. Cleat 2010 may be similar to first cleat 110 described above. A resilient member 2046 may be disposed around shaft 2004 of cleat 2012. Resilient member 2046 may be spaced from bottom surface 2008 by a distance H. Distance H may prevent cleat 2010 from contacting bottom surface 2008.

In some embodiments, the resilient members may be attached to and retained on the bottom surface of the sole plate. For example, as shown in FIGS. 1-8, first resilient member 110 may contact bottom surface 108 of sole plate 102 while also being attached to bottom surface 108. Any of the methods described above for attaching the resilient members to the cleats may be used to attach the resilient members to the bottom surface of the sole plate.

The details of FIGS. 6-8 will now be discussed. FIGS. 6-8 show how first resilient member 146 may prevent mud and/or other debris from accumulating on first cleat 110 and/or the area surrounding the cleat. FIG. 6 shows first cleat 110 and first resilient member 146 before article of footwear 100 comes into contact with mud 600. FIG. 7 illustrates first cleat 110 and first resilient member 146 contacts mud 600. First cleat 110 may penetrate mud 600 and first resilient member 146 may be made of a material that allows first resilient member 146 to compress between a bottom surface 108 of sole plate 102 and a top surface of mud 600. FIG. 8 shows first cleat 110 and first resilient member 146 after emerging from mud 600. First resilient member 146 may spring back to its former position after no longer being compressed between bottom surface 108 of sole plate and the top surface of mud 600. As first resilient member 146 springs back to its former position, first resilient member 146 may scrape mud and/or other debris away from the surface of first cleat 110. Additionally, as shown in FIG. 8, the motion of first resilient member 146 may cause bits of mud 800 to fling from first cleat 110. Accordingly, the resilient member may prevent mud from accumulating upon the cleat and/or the area surrounding the cleat.

The details of FIGS. 9-16 will now be discussed. FIGS. 9-16 illustrate an article of footwear 900 having a sole plate 902 and an upper 904. Sole plate 902 may have the same basic features described above with respect to sole plate 102. For example, sole plate 902 may have a top surface 1006 and a bottom surface 908. In another example, sole plate 902 may have a forefoot region 940, heel region 942, midfoot region 944, medial side 972, lateral side 970, forward edge, and rearward edge. Sole plate 902 may have a first cleat 910, a second cleat 912, a third cleat 914, a fourth cleat 916, fifth cleat 918, a sixth cleat 920, a seventh cleat 922, and a eighth cleat 924 may be disposed on forefoot region 940 of sole plate 902. A ninth cleat 926, a tenth cleat 928, an eleventh cleat 930, and a twelfth cleat 932 may be disposed on heel region 942 of sole plate 902. A thirteenth cleat 934, a fourteenth cleat 936, and a fifteenth cleat 938 may be disposed on forefoot region 940 of sole plate 902. While not shown, in other embodiments, a resilient member may be disposed on thirteenth cleat 934, fourteenth cleat 936, and/or fifteenth cleat 938.

As shown in FIGS. 9-16, a first resilient member 946 may be disposed on first cleat 910. A second resilient member 948 may be disposed on second cleat 912. A third resilient member 950 may be disposed on third cleat 914. A fourth resilient member 952 may be disposed on fourth cleat 916. A fifth resilient member 954 may be disposed on fifth cleat 918. A sixth resilient member 956 may be disposed on sixth cleat 920. A seventh resilient member 958 may be disposed on seventh cleat 922. An eighth resilient member 960 may be disposed on eighth cleat 924. A ninth resilient member 962 may be disposed on ninth cleat 926. A tenth resilient member 964 may be disposed on tenth cleat 928. An eleventh resilient member 966 may be disposed on eleventh cleat 130. A twelfth resilient member 968 may be disposed on twelfth cleat 932.

Figure 14:
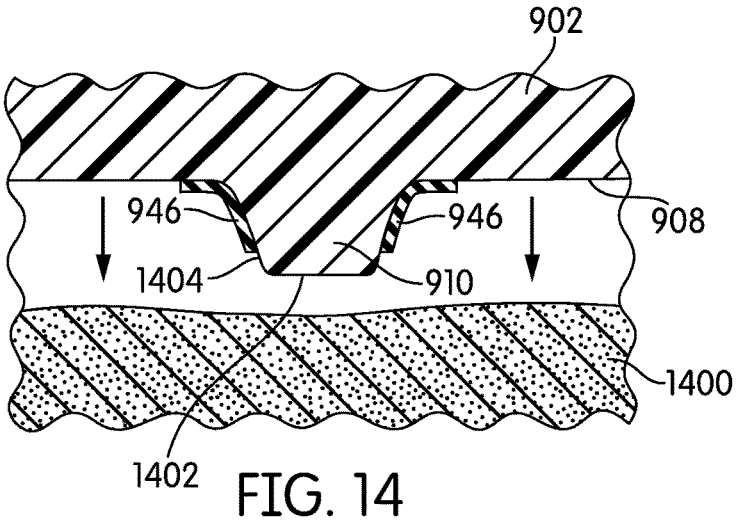
FIG. 14 is a side view of the first cleat of the sole plate of FIG. 9 before being submerged in mud.
Figure 15:
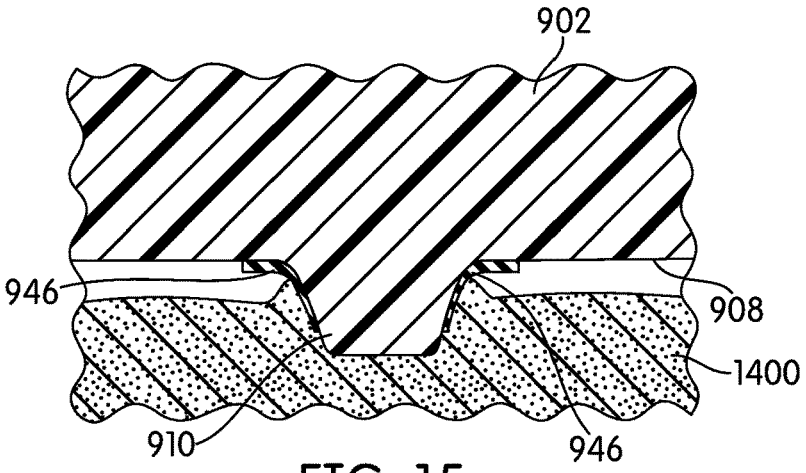
FIG. 15 is a side view of the first cleat of the sole plate of FIG. 9 being submerged in mud.

As shown in FIGS. 14-16, first resilient member 946 may prevent mud and/or other debris from accumulating on first cleat 910 and/or the area surrounding the cleat. FIG. 14 shows first cleat 910 and first resilient member 946 before article of footwear 900 comes into contact with mud 1400. FIG. 15 illustrates first cleat 910 and first resilient member 946 contacts mud 1400. First cleat 910 may penetrate mud 1400 and first resilient member 946 may be made of a material that allows first resilient member 946 to compress between a bottom surface 908 of sole plate 902 and a top surface of mud 1400. FIG. 16 shows first cleat 910 and first resilient member 946 after emerging from mud 1400. First resilient member 946 may spring back to its former position after no longer being impressed between bottom surface 908 of sole plate and the top surface of mud 1400. As first resilient member 946 springs back to its former position, first resilient member 946 may scrape mud and/or other debris away from the surface of first cleat 910. Additionally, as shown in FIG. 16, the motion of first resilient member 946 may cause bits of mud 1600 to fling from first cleat 910. Accordingly, first resilient member 946 may prevent mud from accumulating upon first cleat 910 and/or the area surrounding the cleat.

The details of FIG. 17 will now be discussed. FIG. 17 illustrates an article of footwear 1700 having a sole plate 1702 and an upper 1704. Sole plate 1702 may have the same basic features described above with respect to sole plate 102. For example, sole plate 1702 may have a top surface and a bottom surface 1708. In another example, sole plate 1702 may have a forefoot region 1740, heel region 1742, midfoot region 1744, medial side 1772, lateral side 1770, forward edge, and rearward edge. Sole plate 1702 may have a first cleat 1710, a second cleat 1712, a third cleat 1714, a fourth cleat 1716, a fifth cleat 1718, a sixth cleat 1720, a seventh cleat 1722, and a eighth cleat 1724 may be disposed on forefoot region 1740 of sole plate 1702. A ninth cleat 1726, a tenth cleat 1728, an eleventh cleat 1730, and a twelfth cleat 1732 may be disposed on heel region 1742 of sole plate 1702. A thirteenth cleat 1734, a fourteenth cleat 1736, and a fifteenth cleat 1738 may be disposed on forefoot region 1740 of sole plate 1702.

As shown in FIG. 17, a first resilient member 1748 may be disposed on a second cleat 1712. A second resilient member 1752 may be disposed on fourth cleat 1716. A third resilient member 1754 may be disposed on fifth cleat 1718. A fourth resilient member 1756 may be disposed on sixth cleat 1720. A fifth resilient member 1758 may be disposed on seventh cleat 1722. A sixth resilient member 1760 may be disposed on eighth cleat 1724. A seventh resilient member 1762 may be disposed on ninth cleat 1726. An eighth resilient member 1766 may be disposed on eleventh cleat 1730.

In some embodiments, as shown in FIG. 17, the two front most cleats on the lateral and medial sides (first cleat 1710 and third cleat 1714) and the two backmost cleats (tenth cleat 1728 and twelfth cleat 1732) may lack resilient members. In some embodiments, the absence of the resilient members may be based on the size of the cleats. For example, the cleats may be too small for resilient members. While the two front most cleats on the lateral and medial sides and the two backmost cleats are shown as lacking resilient members, other cleats may lack resilient members in other embodiments. The presence or absence of resilient members on each cleat may be selected based on the type of cleats and/or the cleat pattern (arrangement).

The details of FIG. 18 will now be discussed. FIG. 18 illustrates an article of footwear 1800 having a sole plate 1802 and an upper 1804. Sole plate 1802 may have the same basic features described above with respect to sole plate 102. For example, sole plate 1802 may have a top surface and a bottom surface 1808. In another example, sole plate 1802 may have a forefoot region 1840, heel region 1842, midfoot region 1844, medial side 1872, lateral side 1870, forward edge, and rearward edge. Sole plate 1802 may have a first cleat 1810, a second cleat 1812, a third cleat 1814, a fourth cleat 1816, a fifth cleat 1818, a sixth cleat 1820, a seventh cleat 1822, and a eighth cleat 1824 may be disposed on forefoot region 1840 of sole plate 1802. A ninth cleat 1826, a tenth cleat 1828, an eleventh cleat 1830, and a twelfth cleat 1832 may be disposed on heel region 1842 of sole plate 1802. A thirteenth cleat 1834, a fourteenth cleat 1836, and a fifteenth cleat 1838 may be disposed on forefoot region 1840 of sole plate 1802.

As shown in FIG. 18, a first resilient member 1846 may be disposed on first cleat 1810. A second resilient member 1848 may be disposed on second cleat 1812. A third resilient member 1850 may be disposed on third cleat 1814. A fourth resilient member 1852 may be disposed on fourth cleat 1816. A fifth resilient member 1854 may be disposed on fifth cleat 1818. A sixth resilient member 1856 may be disposed on sixth cleat 1820. A seventh resilient member 1858 may be disposed on seventh cleat 1822. An eighth resilient member 1860 may be disposed on eighth cleat 1824. A ninth resilient member 1862 may be disposed on ninth cleat 1826. A tenth resilient member 1864 may be disposed on tenth cleat 1828. An eleventh resilient member 1866 may be disposed on eleventh cleat 1830. A twelfth resilient member 1868 may be disposed on twelfth cleat 1832.

In some embodiments, as shown in FIG. 18, the resilient members on the two front most cleats on the lateral and medial sides (first cleat 1810 and third cleat 1814) and the two backmost cleats (tenth cleat 1828 and twelfth cleat 1832) may be smaller than the other resilient members. In some embodiments, the size of the resilient members may be reduced based on the reduced size of the cleats. In other embodiments, the size of the resilient members may be reduced based on the fact that the cleats selected to have the smaller resilient members tend to collect less mud and/or debris than the other cleats. While the two front most cleats on the lateral and medial sides and the two backmost cleats are shown having smaller resilient members, other cleats may have differently sized resilient members in other embodiments. The size of the resilient members assigned to each cleat may be selected based on the type of cleats and/or the cleat pattern (arrangement).

The details of FIG. 19 will now be discussed. FIG. 19 illustrates an article of footwear 1900 having a sole plate 1902 and an upper 1904. Sole plate 1902 may have the same basic features described above with respect to sole plate 102. For example, sole plate 1902 may have a top surface and a bottom surface 1908. In another example, sole plate 1902 may have a forefoot region 1940, heel region 1942, midfoot region 1944, medial side 1972, lateral side 1970, forward edge, and rearward edge. Sole plate 1902 may have a first cleat 1910, a second cleat 1912, a third cleat 1914, a fourth cleat 1916, a fifth cleat 1918, a sixth cleat 1920, a seventh cleat 1922, and a eighth cleat 1924 may be disposed on forefoot region 1940 of sole plate 1902. A ninth cleat 1926, a tenth cleat 1928, an eleventh cleat 1930, and a twelfth cleat 1932 may be disposed on heel region 1942 of sole plate 1902. A thirteenth cleat 1934, a fourteenth cleat 1936, and a fifteenth cleat 1938 may be disposed on forefoot region 1940 of sole plate 1902.

As shown in FIG. 19, a first resilient member 1946 may be disposed on first cleat 1910. A second resilient member 1948 may be disposed on second cleat 1912. A third resilient member 1950 may be disposed on third cleat 1914. A fourth resilient member 1952 may be disposed on fourth cleat 1916. A fifth resilient member 1954 may be disposed on fifth cleat 1918. A sixth resilient member 1956 may be disposed on sixth cleat 1920. A seventh resilient member 1958 may be disposed on seventh cleat 1922. An eighth resilient member 1960 may be disposed on eighth cleat 1924. A ninth resilient member 1962 may be disposed on ninth cleat 1926. A tenth resilient member 1964 may be disposed on tenth cleat 1928. An eleventh resilient member 1966 may be disposed on eleventh cleat 1930. A twelfth resilient member 1968 may be disposed on twelfth cleat 1932.

In some embodiments, as shown in FIG. 19, the resilient members on the two front most cleats on the lateral and medial sides (first cleat 1910 and third cleat 1914) and the two backmost cleats (tenth cleat 1928 and twelfth cleat 1932) may be shaped differently from the other resilient members. In some embodiments, the shape of the resilient members may be based on the size and/or shape of the cleats. In other embodiments, the shape of the resilient members may be based on the fact that the cleats selected to have differently shaped resilient members tend to collect mud and/or debris in a different way than the other cleats. While the two front most cleats on the lateral and medial sides and the two backmost cleats are shown having differently shaped resilient members from the other cleats, other cleats may have differently shaped resilient members in other embodiments. The shape of the resilient members assigned to each cleat may be selected based on the type of cleats and/or the cleat pattern (arrangement).

A method of making the described article of footwear may include a step of providing a sole plate including a bottom surface having a forefoot region, a heel region, a longitudinal axis extending through the forefoot region and heel region, a forward edge, and a rearward edge. The sole plate may include a first cleat disposed on the bottom surface of the sole plate. The first cleat may have a shaft extending away from the bottom surface of the sole plate and a terminal end disposed opposite the bottom surface of the sole plate. The method may further include a step of placing a first resilient member on the shaft of the first cleat.

In some embodiments, the step of placing the first resilient member on the shaft of the first cleat may include placing the first resilient member around the shaft in a position disposed between the sole plate and the terminal end of the cleat.

In some embodiments, the step of placing the first resilient member on the shaft of the first cleat may include placing the first resilient member along an area where the bottom surface of the sole plate and the shaft of the first cleat meet.

In some embodiments, the method may further include a step of placing a second resilient member on the shaft of a second cleat of the sole plate.

In some embodiments, the steps of placing the first resilient member on the shaft of the first cleat and placing the second resilient member on the shaft of the second cleat may include permanently affixing the respective resilient member to the respective cleat. For example, adhesive or bonding may be used to permanently affix the respective resilient member to the respective cleat.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims. The various embodiments of the invention described herein may be combined to form other embodiments. Features described with respect to one embodiment may be included in another embodiment.

What is claimed is:

1. An article of footwear comprising:

a sole plate including a bottom surface having a forefoot region, a heel region, a longitudinal axis extending through the forefoot region and heel region, a forward edge, and a rearward edge;

a first cleat disposed on the bottom surface of the sole plate, the first cleat having a shaft extending away from the bottom surface of the sole plate and a terminal end disposed opposite the bottom surface of the sole plate, the terminal end configured to directly contact a ground surface; and a first resilient member (i) in direct contact with and extending from the bottom surface of the sole plate between a first end and a second end of the first resilient member, (ii) directly bonded to and protruding from an outer surface of the first cleat from the first end to the second end in a relaxed state and a compressed state in, and (iii) configured to be in direct contact with both the bottom surface of the sole plate and the ground surface simultaneously.

2. The article of footwear according to claim 1, wherein the first resilient member is a sheath that substantially surrounds the outer surface of the shaft of the first cleat.

3. The article of footwear according to claim 1, wherein the first resilient member has a toroidal shape.

4. The article of footwear according to claim 1, wherein the first resilient member has a circular cross section.

5. The article of footwear according to claim 1, further comprising:

a second cleat disposed on the bottom surface of the sole plate, the second cleat having a shaft extending away from the bottom surface of the sole plate and a terminal end disposed opposite the bottom surface of the sole plate; and a second resilient member disposed on the shaft of the second cleat and protruding from an outer surface of the second cleat.

6. The article of footwear according to claim 1, wherein the first resilient member is made from at least one of silicone and rubber.

7. The article of footwear according to claim 1, further comprising an upper attached to the sole plate.

8. The article of footwear according to claim 1, wherein the first resilient member is disposed on the shaft of the first cleat between the bottom surface of the sole plate and the terminal end of the first cleat.

9. The article of footwear according to claim 1, wherein the first cleat tapers from the bottom surface of the sole plate to the terminal end.

10. The article of footwear according to claim 1, wherein the first resilient member contacts the shaft of the first cleat at a tapered surface of the first cleat.

11. The article of footwear according to claim 1, wherein the first resilient member completely encircles the outer surface of the shaft of the first cleat.

12. The article of footwear according to claim 1, wherein the first cleat extends through an opening in the first resilient member such that the terminal end of the first cleat is exposed.

13. The article of footwear according to claim 1, wherein the first resilient member terminates at a point between the terminal end of the first cleat and the bottom surface of the sole plate.

14. The article of footwear according to claim 1, wherein the first resilient member substantially surrounds the shaft of the first cleat.

15. The article of footwear according to claim 1, wherein the first resilient member is disposed along an area where the bottom surface of the sole plate and the shaft of the first cleat meet.

16. The article of footwear according to claim 1, wherein the first resilient member is a sheath having a uniform thickness.

17. The article of footwear according to claim 1, wherein the first resilient member is directly bonded to the shaft of the first cleat by an adhesive.

18. The article of footwear according to claim 1, wherein the first resilient member is directly bonded to the shaft of the first cleat by thermal bonding.

19. The article of footwear according to claim 1, wherein the first resilient member is attached to and retained on the bottom surface of the sole plate.

20. The article of footwear according to claim 19, wherein the first resilient member is attached to and retained on the bottom surface of the sole plate by thermal bonding.

* * * * *